US007451559B2

(12) United States Patent
Chen et al.

(10) Patent No.: US 7,451,559 B2
(45) Date of Patent: Nov. 18, 2008

(54) IRON WITH CARTRIDGE

(75) Inventors: Sen Kee Chen, Singapore (SG); Narendra Pawar, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 161 days.

(21) Appl. No.: 10/556,447

(22) PCT Filed: May 12, 2004

(86) PCT No.: PCT/IB2004/050649

§ 371 (c)(1),
(2), (4) Date: Nov. 10, 2005

(87) PCT Pub. No.: WO2004/101879

PCT Pub. Date: Nov. 25, 2004

(65) Prior Publication Data

US 2007/0017128 A1 Jan. 25, 2007

(30) Foreign Application Priority Data

May 16, 2003 (SG) ..... SG03/00133

(51) Int. Cl.
*D06F 75/14* (2006.01)
*D06F 75/36* (2006.01)

(52) U.S. Cl. ..... 38/77.3; 38/77.5; 38/77.81

(58) Field of Classification Search ..... 38/77.1, 38/77.82, 77.2–77.81; 406/169, 191, 192, 406/194; 239/302, 569, 155; 139/329.3; 137/144, 151, 168, 599.17, 601.2
See application file for complete search history.

(56) References Cited

U.S. PATENT DOCUMENTS

| | | | | |
|---|---|---|---|---|
| 2,240,612 | A * | 5/1941 | Ekstedt | 38/77.81 |
| 2,322,593 | A * | 6/1943 | Riddington et al. | 38/77.81 |
| 2,750,695 | A * | 6/1956 | Swenson | 38/77.81 |
| 2,833,062 | A * | 5/1958 | Schott et al. | 38/77.81 |
| 2,837,847 | A * | 6/1958 | Franklin et al. | 38/77.82 |
| 3,609,890 | A * | 10/1971 | Abraham | 38/77.83 |
| 3,811,208 | A * | 5/1974 | Vieceli et al. | 38/77.8 |
| 4,748,755 | A * | 6/1988 | Bain et al. | 38/88 |
| 6,351,901 | B1 | 3/2002 | Amsel | |
| 6,425,197 | B2 | 7/2002 | Ching et al. | |
| 6,745,504 | B2 * | 6/2004 | Sastre et al. | 38/77.82 |
| 6,807,755 | B2 * | 10/2004 | Bontems et al. | 38/77.8 |
| 7,114,273 | B2 * | 10/2006 | Giovalle et al. | 38/77.8 |

FOREIGN PATENT DOCUMENTS

| | | | |
|---|---|---|---|
| CH | 422705 | A1 | 10/1966 |
| FR | 2653455 | A1 | 4/1991 |
| WO | WO 0008247 | A1 | 2/2000 |
| WO | WO 02/02859 | A2 | 1/2002 |

* cited by examiner

*Primary Examiner*—Ismael Izaguirre

(57) ABSTRACT

The invention relates to an iron comprising a cartridge (4) for containing a liquid (5), a nozzle means (6) having at least one aperture (20), a pump means (14) for delivering said liquid to the nozzle means, said cartridge (4) comprising an outer wall (29) with vent means (25) including a vent hole (28) for ventilating said cartridge (4). To prevent soiling of the iron due to spillage of liquid (5) through the vent hole (28), said vent means (25) comprises a storage chamber (26)for receiving an excess of liquid from the cartridge.

9 Claims, 2 Drawing Sheets

IRON WITH CARTRIDGE

Figure 1:
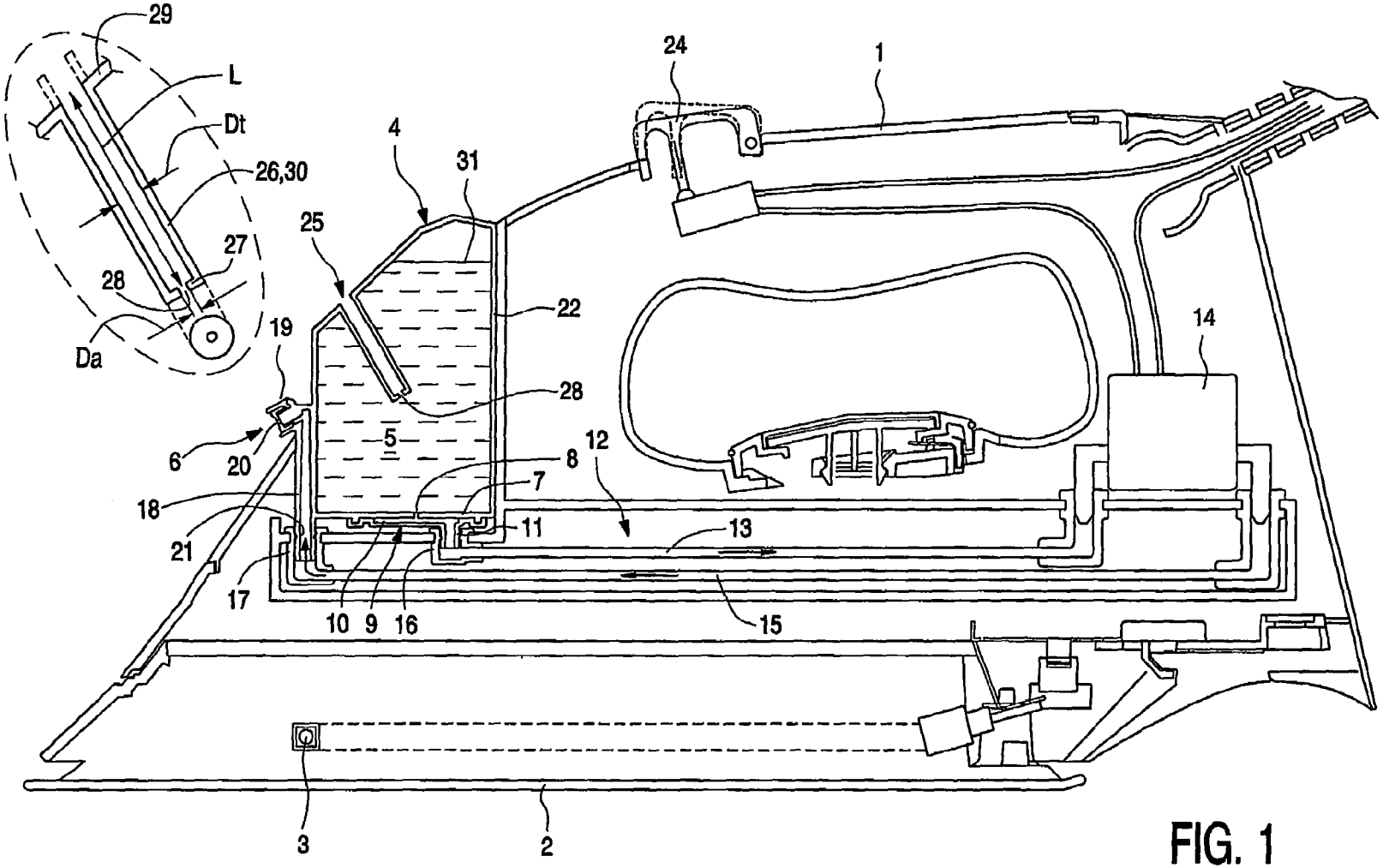

The invention relates to an iron comprising: a cartridge for containing a liquid, a nozzle means having at least one aperture, a pump means for delivering said liquid to the nozzle means, said cartridge comprising an outer wall with vent means including a vent hole for ventilating said cartridge.

The invention also relates to a cartridge suitable for use in an iron as described above.

Such an iron is known from U.S. Pat. No. B2-6,425,197. Ventilating a cartridge is necessary to avoid an under-atmospheric pressure arising inside the cartridge during a spraying operation. When the pump sucks liquid from the cartridge, air is sucked into the cartridge through the vent holes thus keeping the cartridge at atmospheric pressure. A bad ventilation may result in irregular spraying and thus in a non-uniform moistening of the garment to be ironed. A problem of vent means is that liquid often leaks through the vent hole during an ironing operation and soils the housing of the iron and a user's hand(s). This is obviously undesired, in particular when the liquid is an additive that comprises siloxanes. In particular, spilling of liquid through the vent hole occurs when the iron is put in its so-called heel position, which is a position in which the soleplate of an iron is substantially vertical, but spilling of liquid should be prevented as much as possible also in a horizontal position of the iron. To prevent such liquid spillage, it is possible to provide the hole with a one-way valve or to cover the hole with a certain material, such as Goretex™, that enables air to pass through the material in one direction and prevents liquid from passing through the material in the other direction. However, the disadvantage of these solutions is that as time goes by the one-way valve or such a material will become soiled and clogged up and will thus not function properly anymore.

It is an object of the invention to provide the cartridge of an iron with vent means that prevent soiling of the iron due to any spillage of liquid through the vent hole.

According to the invention, this object is achieved in that the vent means comprises a storage chamber for receiving an excess of liquid from the cartridge passing through said vent hole, said storage chamber being open to the open air.

If the level of the liquid in the cartridge is above the vent hole, liquid can leak through the vent hole into the storage chamber. However, only a small amount of liquid will flow through the vent hole because, as soon as liquid pours from the cartridge, an under-atmospheric pressure arise inside the cartridge so that a further outward flow of liquid is prevented. This results in a pressure balance. The storage chamber prevents a spillage of liquid and hence soiling of the iron. As a pressure balance will be established quickly, the storage chamber can be kept small in size. As soon as the liquid level reaches a position below the vent hole, for example because the user puts the iron in another position such as from the heel position to the usual, horizontal ironing position, the excess liquid in the storage chamber will flow back into the cartridge. Also when the user starts the pump (electric or hand) for spraying operations, the excess liquid will flow back into the cartridge.

A preferred embodiment of the iron is characterized in that an end wall of the storage chamber that faces the inside of the cartridge comprises said vent hole. This ensures a quick and complete emptying of the storage chamber.

Another preferred embodiment of the iron is characterized in that the storage chamber extends from the outer wall toward the inside of the cartridge. In this way the storage chamber or a part thereof does not form an inconvenient extension which projects outwards from the outer wall of the cartridge.

To prevent clogging of the vent hole and to ensure a sufficient venting, the size of the vent hole should be not too small. Therefore, a further embodiment of the iron is characterized in that the cross-sectional area of the vent hole is greater than 0.03 $mm^2$.

To prevent spilling of liquid through the vent hole, in particular when moving the iron during the ironing process while the cartridge is full, the size of the vent hole should be not too large. Therefore, a further embodiment of the iron is characterized in that the cross-sectional area of the vent hole is less than 3 $mm^2$.

A further preferred embodiment of the iron is characterized in that the volume of the storage chamber is at least 1% of the volume of the cartridge. At least 1% will be enough to ensure that an expansion of air trapped in the cartridge will not cause any spillage of liquid. Preferably, the volume of the storage chamber is at least 30 $mm^3$.

A further preferred embodiment of the iron is characterized in that the vent hole has a diameter Da greater than 0.4 mm and smaller than 1.2 mm, and that the storage chamber is a tube, an inner diameter Dt thereof being greater than 2.5 mm and smaller than 5.5 mm, a length L of the tube being at least 25 mm.

An alternative embodiment of the iron is characterized in that the storage chamber is a tube with open ends at both sides, an inner diameter Dt of the tube being smaller than 3 mm, and a length L being at least 10 mm.

These and other aspects of the invention will be apparent from and elucidated with reference to the embodiment described hereinafter.

IN THE DRAWINGS

Figure 2:
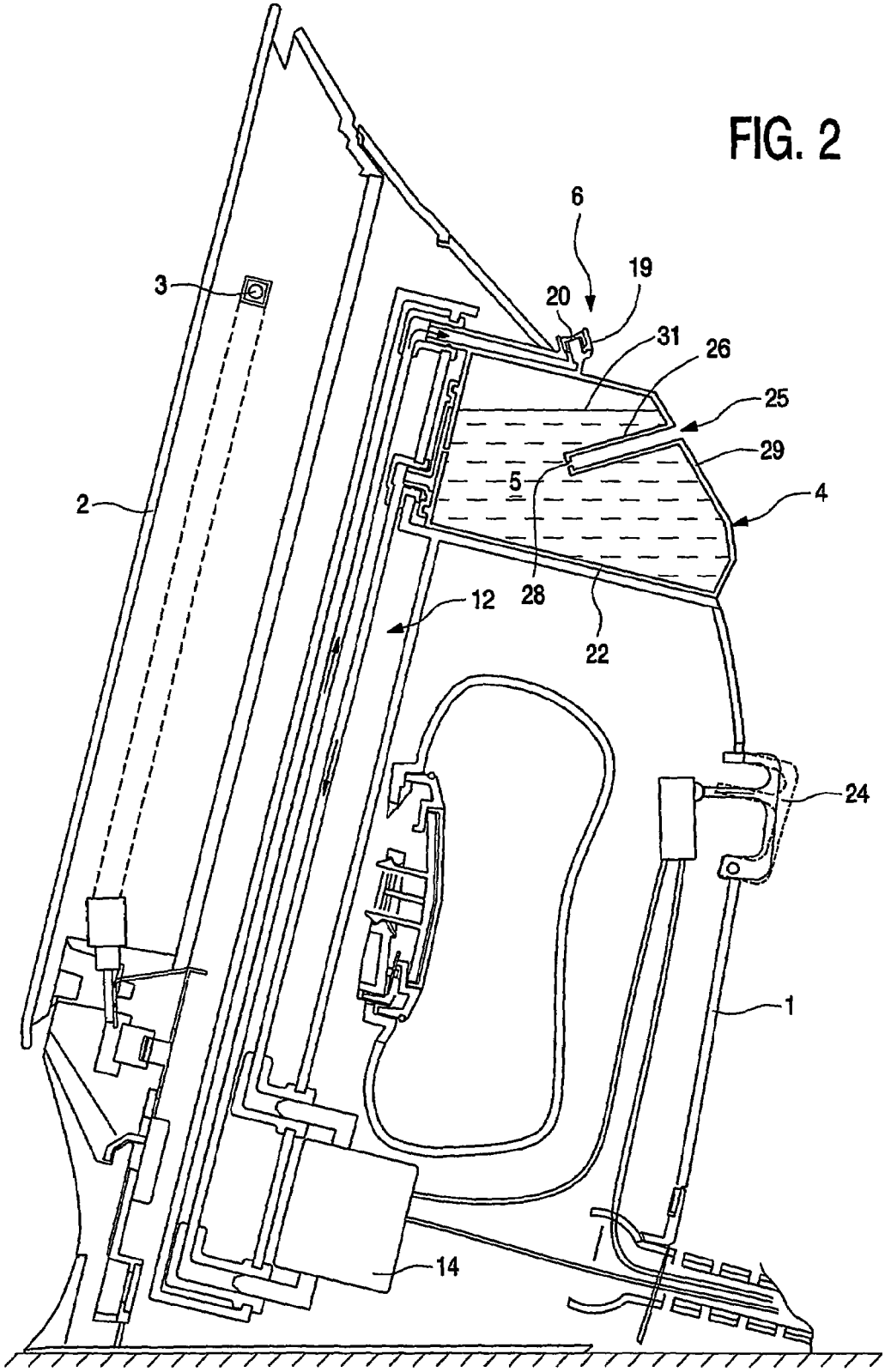

FIG. 1 is a diagrammatic cross-sectional view of an iron with a cartridge wherein the iron is in its operating position, and FIG. 2 is a diagrammatic cross-sectional view of an iron with a cartridge of FIG. 1 wherein the iron is in its heel rest position.

An iron according to the invention as shown in FIG. 1 comprises a housing 1, a sole plate 2, a heating element 3 for heating the sole plate, an exchangeable reservoir 4 for containing a liquid 5, and a spraying nozzle means 6. The exchangeable reservoir 4 may be a kind of cassette or cartridge 4 with a hard synthetic resin housing. The liquid 5 in the cartridge may be a so-called additive liquid which can be used, for example, to improve the wrinkle resistance of the garment or for easier gliding of the soleplate over the garment. The bottom 7 of the cartridge 4 is provided with an outlet 8 for the liquid 5. A coupling piece 9 is connected at the lower side of the bottom 7, which coupling piece has a duct 10 of which an inlet is in communication with the outlet 8 of the cartridge 4 and of which an outlet terminates in an outlet tube 11. The coupling piece 9 may be integral with the cartridge 4. The iron comprises a delivery system 12 for delivering the liquid 5 from the cartridge 4 to the nozzle means 6 in order for it to be sprayed on the cloth to be ironed. The delivery system comprises a first channel 13, an outlet thereof being connected to an inlet of an electric pump 14 arranged inside the housing of the iron, and a second channel 15, an inlet thereof being connected to an outlet of the pump 14. An inlet of the channel 13 is provided with a coupling sleeve 16 for coupling to the outlet tube 11 of the coupling piece 9. An outlet of the second channel 15 is provided with a coupling sleeve 17. The cartridge 4 is provided with the nozzle means 6. The nozzle means comprises a nozzle tube 18 terminating in a nozzle 19 having an aperture 20. An inlet of the nozzle tube forms a coupling tube 21 for coupling to the coupling sleeve 17 of the second channel 15. The cartridge 4 can be inserted into a cavity 22 of the iron. When an additive spray is desired, the user starts the pump 14 by pressing a knob 24. The pump sucks the additive liquid 5 from the cartridge 4 into the channel 13 and pumps it via the channel 15 and the nozzle tube 18 towards the nozzle 19.

The cartridge 4 is provided with vent means 25 for ventilating the cartridge. The vent means comprises a storage chamber 26. An end wall 27 of the storage chamber that faces the inside of the cartridge has a vent hole 28. In this embodiment the entire storage chamber extends from an outer wall 29 of the cartridge toward the inside of the cartridge. Alternatively, however, part of the storage chamber 26 may project to the outside of the cartridge as indicated with dashed lines in the encircled enlarged view of the vent means 25. However, it is preferred for aesthetic reasons as well as for convenient handling of the cartridge that the entire storage chamber 26 extends inside the cartridge 4. The storage chamber may be shaped as a round tube or may have alternative shapes, such as a square shape. In a preferred embodiment, the storage chamber has the shape of a tube 30 wherein the diameter Da of the vent hole 28 is between 0.4 mm and 1.2 mm, the inner diameter Dt of the tube 30 is between 2.5 mm and 5.5 mm, and the length L of the tube 30 is at least 25 mm. With these dimensions spilling of liquid 5 is prevented on the one hand while on the other hand clogging of the vent hole 28 will not occur. If the liquid level 31 in the cartridge 4 is above the vent hole 28, the static pressure pushes some liquid through the vent hole 28 into the storage chamber 26. This causes an underpressure in the cartridge until a pressure balance is reached. Only a small amount of liquid passes through the vent hole 28 and enters the storage chamber 26. Withdrawing liquid from the cartridge during operation causes an increase in the underpressure in the cartridge, so that air from the outside and any excess liquid in the storage chamber 26 are sucked into the cartridge 4 through the vent hole 28. It will be clear that, when the iron is put in its heel position as shown in FIG. 2, no liquid will leak from the storage chamber either.

In an alternative embodiment which is not shown, the storage chamber may be a tube open at both ends wherein the diameter Da=Dt. Preferably, Dt is less than 3 mm and the length L of the tube is at least 10 mm.

If the liquid is an additive liquid in a concentrated form, it can be diluted with water from a water reservoir of the iron as described in the second embodiment of WO-A-02/002859.

The invention claimed is:

1. Iron comprising a cartridge (4) for containing a liquid (5), a nozzle means (6) having at least one aperture (20), a pump means (14) for delivering said liquid to the nozzle means, said cartridge (4) comprising an outer wall (29) with vent means (25) including a vent hole (28) for ventilating said cartridge, wherein the vent (25) comprises a storage chamber (26) for receiving an excess of liquid (5) from the cartridge (4) passing through said vent hole (28), said storage chamber further comprising:

a tube having a diameter $D_l$ and a vent hole having a diameter $D_a$, wherein $D_t$ is greater than $D_a$.

2. Iron as claimed in claim 1, wherein an end wall (27) of the storage chamber (26) that faces the inside of the cartridge (4) comprises said vent hole (28).

3. Iron as claimed in claim 1,wherein at least a major portion of the storage chamber (26) extends from said outer wall (29) of the cartridge (4) toward the inside of the cartridge.

4. Iron as claimed in claim 1, wherein the cross-sectional area of the vent hole (28) is greater than 0.03 $mm^2$.

5. Iron as claimed in claim 1, wherein the cross-sectional area of the vent hole (28) is smaller than 3 $mm^2$.

6. Iron as claimed in claim 1, wherein the volume of the storage chamber (26) is at least 30 $mm^3$.

7. Iron as claimed in claim 6, wherein the volume of the storage chamber (26) is at least 1% of the volume of the cartridge (4).

8. Iron as claimed in claim 1, wherein Da is greater than 0.4 mm and smaller than 1.2 mm, and Dt is greater than 2.5 mm and smaller than 5.5 mm, and wherein a length L of the tube being at least 25 mm.

9. Iron as claimed in claim 1, wherein the tube has open ends at both sides, wherein Dt is smaller than 3 mm, and wherein the storage chamber has a length L being at least 10 mm.

* * * * *